US007866668B2

(12) United States Patent
Huang

(10) Patent No.: US 7,866,668 B2
(45) Date of Patent: Jan. 11, 2011

(54) ELECTRIC DARTBOARD

(76) Inventor: Yuh-Shiang Huang, 3F-5, No. 262, Sec. 2, Henan Rd., Situn District, Taichung City 407 (TW)

( * ) Notice: Subject to any disclaimer, the term of this patent is extended or adjusted under 35 U.S.C. 154(b) by 0 days.

(21) Appl. No.: 12/422,257

(22) Filed: Apr. 11, 2009

(65) Prior Publication Data

US 2010/0259009 A1 Oct. 14, 2010

(51) Int. Cl.
*F41J 5/052* (2006.01)

(52) U.S. Cl. ..... 273/376

(58) Field of Classification Search ..... 273/371–377, 273/403–410, 359, 366–370
See application file for complete search history.

(56) References Cited

U.S. PATENT DOCUMENTS 1,076,002 A * 10/1913 Clarke ..... 273/368
2,077,001 A * 4/1937 Moss et al. ..... 273/368
2,179,471 A * 11/1939 Lee ..... 273/368
3,784,201 A * 1/1974 Wyman et al. ..... 273/348.4
3,850,432 A * 11/1974 Crocker ..... 273/368
4,314,703 A * 2/1982 Grottola ..... 273/408
4,415,162 A * 11/1983 Sheppard ..... 273/371
5,603,503 A * 2/1997 Lapidus ..... 273/348.2
5,613,685 A * 3/1997 Stewart et al. ..... 273/374
5,642,886 A * 7/1997 Yancey, Jr. ..... 273/408
6,726,209 B2 * 4/2004 Kim ..... 273/408
7,578,508 B2 * 8/2009 Caspi et al. ..... 273/359
2007/0001400 A1 * 1/2007 Stewart ..... 273/348
2009/0218769 A1 * 9/2009 Krzewicki et al. ..... 273/374

* cited by examiner

*Primary Examiner*—Mark S Graham

(57) ABSTRACT

An electric dartboard includes a base, a dart frame, a plurality of score blocks and a touch sensor. A positioning ball and a resilient member are disposed at a predetermined position of the base. The dart frame, rotatably in 360 degrees, is disposed in the receiving zone, and the dart frame includes an upper frame body and a lower frame base. A plurality of first positioning recesses are formed on an outer periphery of the frame base for receiving the positioning ball therein. Score blocks are disposed between the frame body and the frame base, while the touch sensor is disposed between the receiving zone and the dart frame. The dart frame and the score blocks can rotate in 360 degrees relative to the base.

11 Claims, 3 Drawing Sheets

ELECTRIC DARTBOARD

BACKGROUND OF THE INVENTION

1. Field of the Invention

The present invention relates to an electric dartboard.

2. Description of the Prior Art

The bodies of the electric dartboards in the market are formed with irrigating engineering plastic materials. Accordingly, only plastic dart points can be used to shoot the dartboards, which frequently causes disengagement of the darts from the dartboard or even worse, the dart points ended up broken in the dartboards.

Furthermore, dart points made of steel are also applied to a dart game to shoot conventional electric sisal dartboard to avoid the frequent disengagement of the dart from the board. The disadvantage with steel dart points is that after the sisal dartboard is used for a period of time, the fiber of the dartboard will be pierced badly by the steel points, causing disengagement of the darts from the dartboard and affecting adversely display of the score on the dartboard.

The present invention has arisen to mitigate and/or obviate the afore-described disadvantages.

SUMMARY OF THE INVENTION

The main object of the present invention is to provide an electric dartboard of which the dart frame can be rotated to turn a worn-out score block to a lower score displaying zone, reducing the chances of the worn-out score block to be a frequent shoot target anymore and evening out the chances of being a shoot target for all score blocks, improving the life cycle of an electric dartboard.

To achieve the above object, an improved electric dartboard with a rotatable dart frame is provided. The electric dartboard of the present invention includes a base, a dart frame, a plurality of score blocks and a touch sensor. A ball and a resilient member are disposed at a predetermined position of the base. The dart frame is rotatably disposed in the receiving zone, and the dart frame includes an upper frame body and a lower frame base. A plurality of first positioning recesses are formed on an outer periphery of the frame base for receiving the ball therein. Moreover, the score blocks are disposed between the frame body and the frame base, while the touch sensor is disposed between the receiving zone and the dart frame. Therefore, the dart frame and the score blocks can rotate in a full 360-degree manner relative to the base, evening out the chances of being the shooting target for the score blocks and extending the life cycle of electric dartboards.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figures 1, 1A, 1B, 1C:
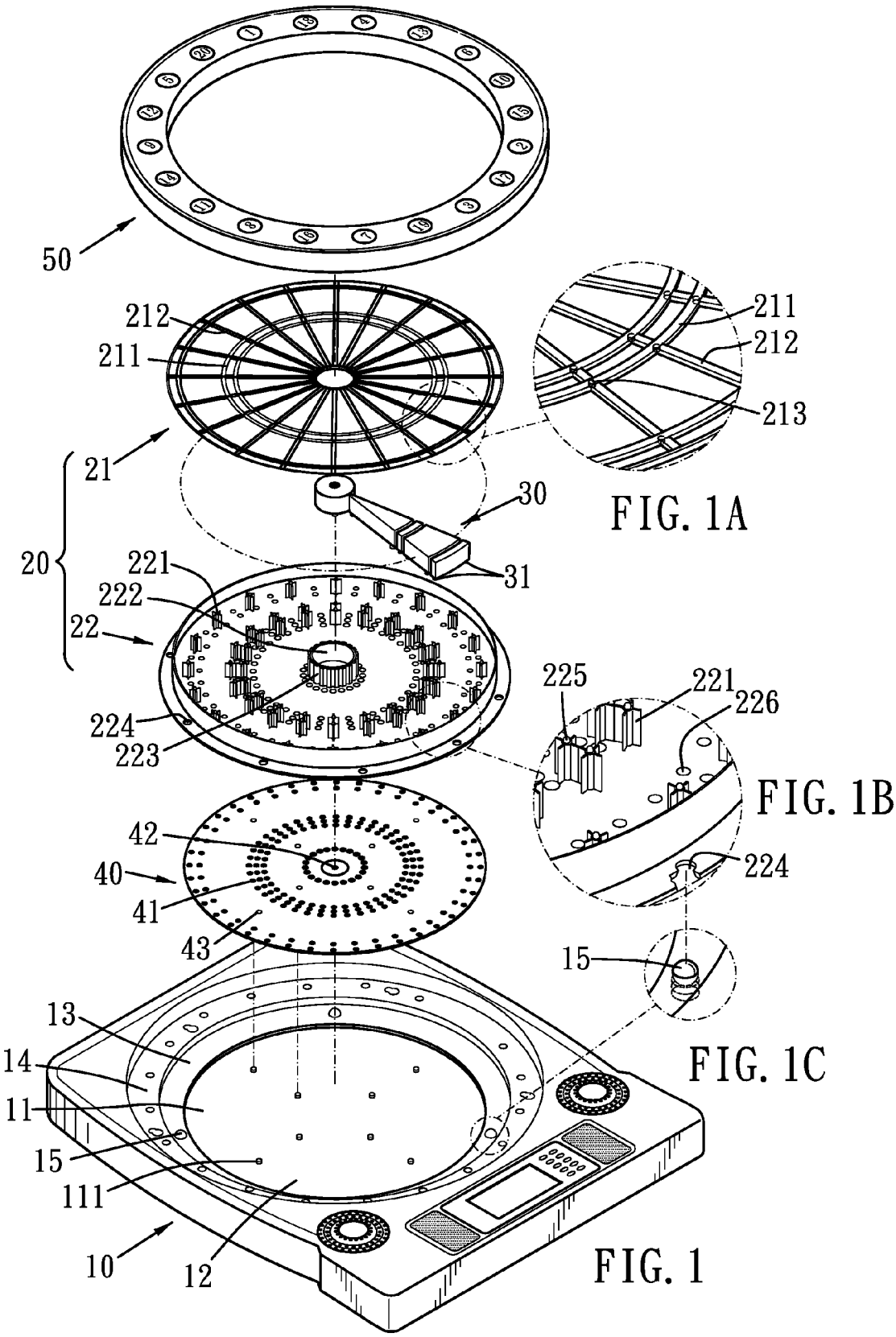
FIG. 1 is an exploded view of an electric dartboard in accordance with a preferred embodiment of the present invention.
FIG. 1A is a partial enlarged drawing showing a frame body of the electric dartboard in accordance with a preferred embodiment of the present invention.
FIG. 1B is a partial enlarged drawing showing a frame base of the electric dartboard in accordance with a preferred embodiment of the present invention.
FIG. 1C is a partial enlarged drawing showing a receiving zone of the electric dartboard in accordance with a preferred embodiment of the present invention.
Figure 2:
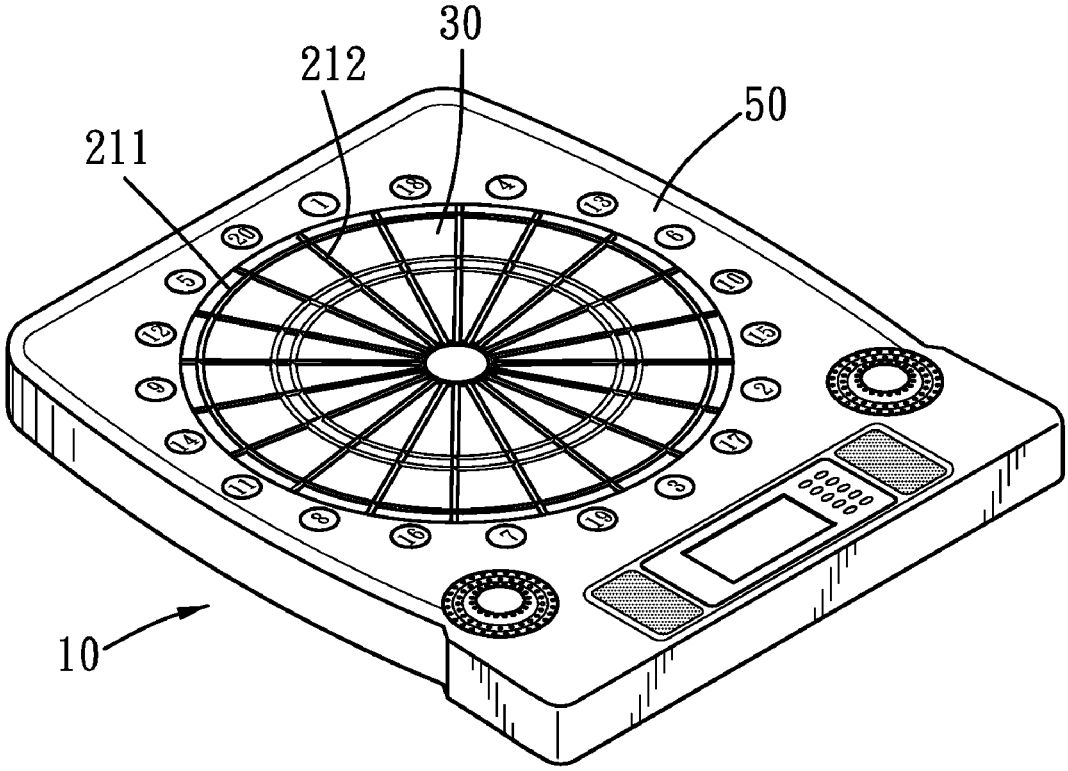
FIG. 2 is an assembly view of the electric dartboard in accordance with a preferred embodiment of the present invention.

Please refer to FIG. 1, FIGS. 1A-1C and FIG. 2. An electric dartboard in accordance with a preferred embodiment of the present invention includes a base 10, a dart frame 20, a plurality of score blocks 30, a touch sensor 40 and an outer loop 50, marked with 1-digit and 2-digit numerals evenly distributed on the surface thereof.

The base 10 has a receiving zone 11, which preferably includes a bottom floor 12, a first annular stair 13 and a second annular stair 14. A plurality of receiving bores (not numerically represented in FIG. 1) are formed on the first annular stair 13, a positioning member 15 and a resilient member (not numerically represented in FIG. 1) are received in each of the receiving bores. For instance, the positioning ball 15 is embodied as a steel ball, while the resilient member is embodied as a coil spring, with each of two ends of the resilient member butting against the receiving bore and the positioning ball 15, respectively.

The dart frame 20 is disposed in the receiving zone 11 for being rotatable in a 360-degree manner. More specifically, the dart frame 20 includes an upper frame body 21 and a lower frame base 22, and the lower frame base 22 is disposed over the first annular stair 13. The frame body 21 includes a plurality of concentric loops 211 of different diameters, and a plurality of radial ribs 212 distributed from the center (of the concentric loops 211) and extended along the radius of concentric loops 211, intersecting with concentric loops 211 at crossed posts 221.

A plurality of crossed posts 221 are integrally formed over the upper surface the lower frame base 22, distributed along the rim of the surface thereof. A cylinder member 222 of a predetermined diameter is integrally formed over the center of the upper surface of the frame base 22, with the predetermined diameter of the cylinder member 222 corresponding to the smallest diameter of concentric loops 211. Preferably, a plurality of longitudinal ribs 223 are formed over the outer surface of the cylinder member 222. Furthermore, a plurality of first positioning recesses 224 are evenly distributed over the outmost periphery of the frame base 22 for receiving the ball 15 therein. Preferably, each first positioning recess 224 is formed in the shape of a concave arc, corresponding to the contact surface of the positioning ball 15, for the positioning ball 15 to be slidably received in the first positioning recess 224. In the present embodiment, the frame body 21 is mounted to the crossed posts 221 by a plurality of protrusions 225 which correspond to a plurality of holes 213. To be more specific, protrusions 225 are positioned at the top of the crossed posts 221, and the holes 213 are formed at the intersection of the concentric loops 211 with the radial ribs 212; or, alternatively, protrusions 225 are positioned at the intersection of the concentric loops 211 with the radial ribs 212, while the holes 213 are disposed to correspond physically to the intersection of the concentric loops 211 with the radial ribs 212.

Moreover, the structure of the score blocks 30 are formed to correspond to the hollow center of the frame body 21 for the former to be secured in between the frame body 21 and the frame base 22. Over the surface of the score blocks facing the base 10 are formed a plurality of touch bosses 31, with the frame base 22 including a plurality of bores 226 for accommodating the touch bosses 31.

Furthermore, the touch sensor 40 is disposed between the receiving zone 11 and the dart frame 20. More specifically, the touch sensor 40 is disposed on the bottom floor 12 with a plurality of protruding posts 111; the touch sensor 40 also has a plurality of second positioning recesses 43 corresponding to protruding posts for receiving the protruding posts 111 in positioning and, in the meantime, for avoiding the touch sensor 40 to rotate with the bottom floor 12. In addition, the touch sensor 40 is provided with a plurality of touch points 41 corresponding to the touch bosses 31, and over the touch sensor 40 is further provided with a touch coil 42, corresponding to the cylinder member 222, and the diameter of the touch coil 42 is somewhat less than that of the cylinder member 222.

The external circle 50 is disposed in the receiving zone 11 and surrounds the dart frame 20. More specifically, the external circle 50 is disposed above the second annular stair 14, and a plurality of threaded bores are formed, respectively, on the external circle 50 and the second annular stair 14 for screwing the external circle 50 to the base 10.

Figures 3, 3A:
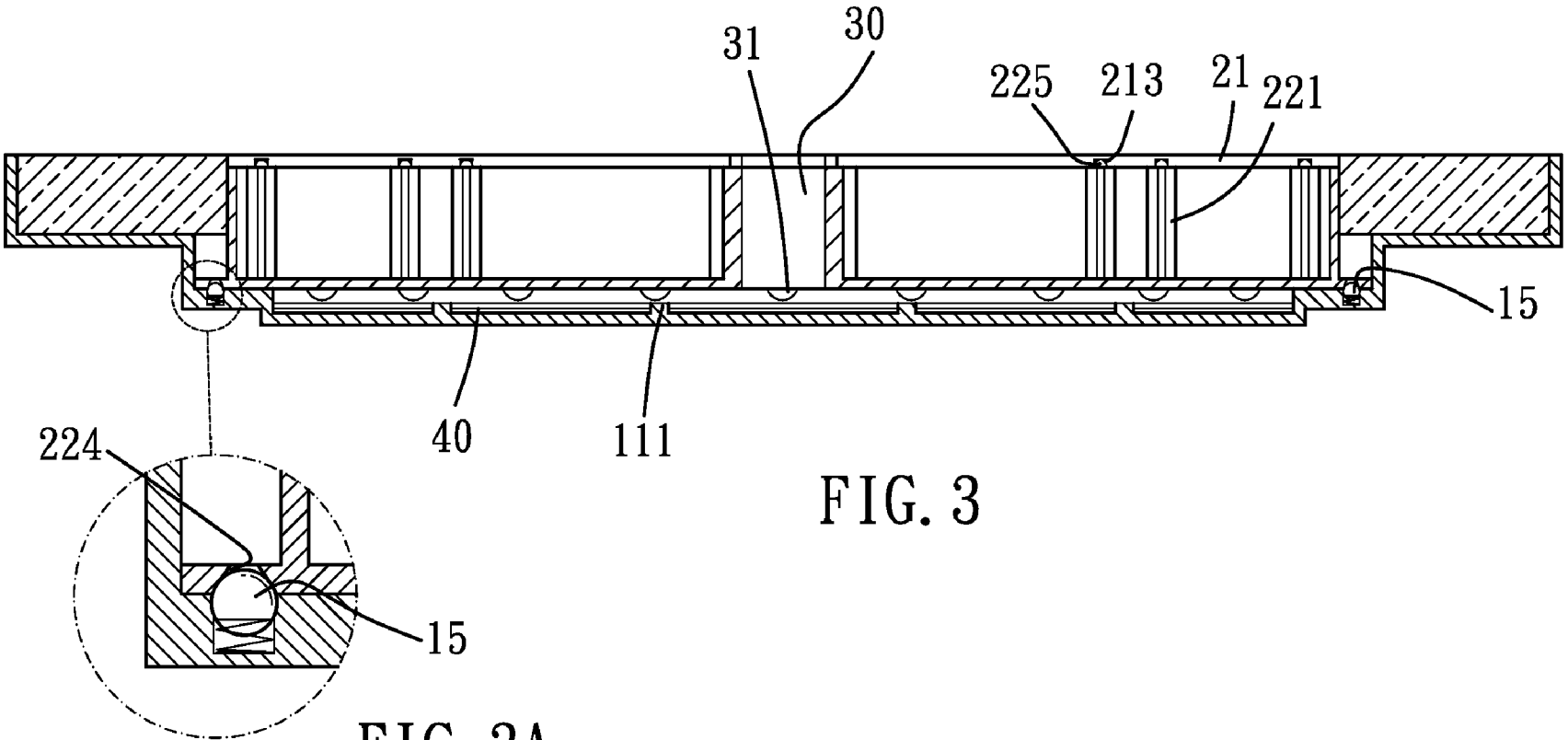
FIG. 3 is a cross sectional view of the electric dartboard in accordance with a preferred embodiment of the present invention.
FIG. 3A is a partial enlarged drawing of FIG. 3.

Next, please refer to FIG. 3 and FIG. 3A. Contributed by the fastening assembly (i.e. a plurality of protrusions 225 and corresponding holes 213) disposed between the frame body 21 and the crossed posts 221, the frame body 21 and the frame base 22 can rotate simultaneously relative to the base 10. A user only needs to push down or pull up the dart frame 20 in displacement to trigger the ball 15 to slide out of the positioning recess 224 (it currently resides in) along the arc surface of the positioning recess 224 and move downwards, making the dart frame 20 rotate relative to the base 10 until the ball 15 is received in the next positioning recess 224.

It is apparent from the above description that the present invention has the following advantages:

The dart frame can be rotated in 360 degrees relative to the base, making the chances of being an aimed target evenly distributed over the score blocks and improves the performance of the electric dartboard. Moreover, it is very convenient to simply pull out or push the dart frame in displacement to make the dart frame rotate. In addition, the frame body is commonly made of metal or alloy, such as zinc alloy, and the frame base is commonly made of plastic, it would be readily realized that the cost and metal consumption in manufacturing the dart frame are significantly reduced since the crossed posts of the present invention are formed on the plastic frame base.

While we have shown and described various embodiments in accordance with the present invention, it is clear to those skilled in the art that further embodiments may be made without departing from the scope of the present invention.

What is claimed is:

1. An electric dartboard comprising:

a base, including a receiving zone, a receiving bore being disposed at a predetermined position of the receiving zone, a positioning ball and a resilient member received in the receiving bore, and two ends of the resilient member abutting against the receiving bore and the positioning ball, respectively;

a dart frame, rotatable in a 360-degree manner, disposed in the receiving zone, the dart frame comprising an upper frame body and a lower frame base, with the upper frame body further comprising a plurality of concentric loops of different diameters, and a plurality of radial ribs arranged radially, wherein the plurality of concentric loops meet with the plurality of radial ribs at intersections; and the lower frame base further comprising a plurality of crossed posts integrally formed thereon for corresponding in position to the intersections, and a cylinder member of a diameter integrally formed thereon with the diameter of the cylinder member corresponding to the smallest diameter of concentric loops of different diameters, and a plurality of first positioning recesses formed on an outer periphery of the frame base for receiving the positioning ball therein;

a plurality of peripheral score blocks, disposed between the frame body and the frame base, one or more touch bosses formed on a surface thereof facing the base, and the frame base further comprising a plurality of bores for receiving the touch bosses; and a touch sensor, disposed between the receiving zone and the dart frame, including a plurality of touch points corresponding to the touch bosses, and a touch coil mounted on the touch sensor of a diameter slightly less than that of the cylinder member, corresponding in position to the cylinder member.

2. The electric dartboard of claim 1, further comprising an external circle with numbers marked around the dart frame, and the external circle being disposed in the receiving zone.

3. The electric dartboard of claim 2, wherein the receiving zone comprises a bottom floor, a first annular stair and a second annular stair, the touch sensor is disposed on the bottom floor, the receiving bore and the dart frame are disposed on the first annular stair, and the external circle is disposed on the second annular stair.

4. The electric dartboard of claim 1, wherein a fastening assembly is disposed between the frame body and the crossed posts for mounting the frame body onto the crossed posts, and the fastening assembly comprises a plurality of protrusions and a plurality of holes for receiving the protrusions.

5. The electric dartboard of claim 2, wherein a fastening assembly is disposed between the frame body and the crossed posts for mounting the frame body onto the crossed posts, and the fastening assembly comprises a plurality of protrusions and a plurality of holes for receiving the protrusions.

6. The electric dartboard of claim 3, wherein a fastening assembly is disposed between the frame body and the crossed posts for mounting the frame body onto the crossed posts, and the fastening assembly comprises a plurality of protrusions and a plurality of holes for receiving the protrusions.

7. The electric dartboard of claim 1, wherein each first positioning recess is formed in the shape of a concave arc, and the positioning ball includes a surface formed corresponding to the shape of the first positioning recesses.

8. The electric dartboard of claim 2, wherein each of the first positioning recesses is formed in the shape of a concave arc, and the positioning ball includes a surface the shape of the first positioning recesses.

9. The electric dartboard of claim 3, wherein each first positioning recess is formed in the shape of a concave arc, and the positioning ball includes a surface corresponding to the shape of the first positioning recesses.

10. The electric dartboard of claim 3, wherein a plurality of protruding posts are disposed on the bottom floor, and the touch sensor includes a plurality of second positioning recesses corresponding to the protruding posts.

11. The electric dartboard of claim 3, wherein a plurality of threaded bores are formed on the external circle and the second annular stair for mounting screws therein.

* * * * *